US005603566A

United States Patent [19]

O'Ryan et al.

[11] Patent Number: 5,603,566

[45] Date of Patent: Feb. 18, 1997

[54] POWDER HOPPER WITH INTERNAL AIR ASSIST

[75] Inventors: David E. O'Ryan, Clarkston, Mich.; Richard D. Burke, Amherst, Ohio

[73] Assignee: ABB Flexible Automation Inc., New Berlin, Wis.

[21] Appl. No.: 561,016

[22] Filed: Nov. 21, 1995

[51] Int. Cl.[6] ..... B01F 13/02

[52] U.S. Cl. ..... 366/107; 34/582

[58] Field of Search ..... 366/101, 106, 366/107, 102, 103, 104, 341, 9, 10, 13, 12, 3; 34/580, 582, 586

[56] References Cited

U.S. PATENT DOCUMENTS

| | | | |
|---|---|---|---|
| 805,795 | 8/1908 | Sampson . | |
| 1,527,491 | 2/1925 | Rose . | |
| 1,877,778 | 9/1932 | Tappan . | |
| 1,971,852 | 8/1934 | Goebels . | |
| 2,125,913 | 8/1938 | Goebels . | |
| 3,179,379 | 4/1965 | Grun et al. . | |
| 3,194,539 | 7/1965 | Hanne-Wiame | 366/101 |
| 3,269,428 | 8/1966 | Stockel et al. . | |
| 3,366,282 | 1/1968 | Lucas . | |
| 3,711,022 | 1/1973 | Witte . | |
| 3,729,176 | 4/1973 | Reich et al. . | |
| 3,826,540 | 7/1974 | Jensen . | |
| 4,042,220 | 8/1977 | Humkey et al. | 366/101 |
| 4,472,062 | 9/1984 | Balzau et al. . | |
| 4,496,076 | 1/1985 | Tompkins . | |
| 4,577,972 | 3/1986 | Shuck et al. | 366/101 |

*Primary Examiner*—Robert W. Jenkins

*Attorney, Agent, or Firm*—Harness, Dickey & Pierce, P.L.C.

[57] ABSTRACT

A powder hopper with an internal air assist is provided with at least one vertically extending tube having a plurality of air outlet ports which are utilized in agitating the powder within a powder chamber. According to a first embodiment, the vertically extending tubes are rotated about a central axis. According to a second embodiment, the vertically extending tube is divided up into a plurality of zones which are sequentially provided with pulses of compressed air, thereby providing an equivalent air agitation rotating action without the requirement of rotating the vertically extending tube.

24 Claims, 3 Drawing Sheets

POWDER HOPPER WITH INTERNAL AIR ASSIST

BACKGROUND OF THE INVENTION

1. Field of the Invention

The present invention relates to a powder hopper for use with a paint spraying apparatus. More particularly, the present invention is directed to a powder hopper with an internal air assist for agitating the powder within the hopper such that it takes on the properties of a liquid.

2. Description of Background Art

In conventional powder hoppers used for supplying spray applicators in paint spray booths, the hopper generally utilizes a fluidized bed at its bottom. This type of powder hopper is illustrated in FIG. 3. As illustrated in FIG. 3, a fluidized level of powder B can be formed in a powder chamber 14 by providing a compressed air chamber 18 below a permeable membrane 30 which allows the compressed air to pass through the non-fluidized level of powder A and form a fluidized level of powder B. However, this conventional powder hopper is insufficient for providing desired fluidized levels. Accordingly, it has been known in the prior art to use mechanical agitators or air assist devices such as air assist rings for agitating the powder within the hopper such that the powder takes on the properties of a liquid.

A problem with the conventional air assist rings is that eventually the assist rings form agglomerations in the powder and do not provide a continuous fluidizing medium in the powder hoppers.

A mechanical-type agitator is disclosed in U.S. Pat. No. 3,711,022 issued to Witte on Jan. 16, 1973. However, the mechanical agitators are noisy and lead to mechanical fatigue of moving parts. In addition, the mechanical agitator of the Witte patent utilizes an electric motor for driving the agitator. The use of an electric motor in the painting environment presents a considerable risk of explosion due to the combustive properties of the powder. Since movable parts within a powder spray environment must be non-electrically driven, conventional powder hoppers have utilized pneumatic systems for driving the mechanical agitators. Such pneumatic systems consume extensive volumes of compressed air to pneumatically drive the agitators. Accordingly, it is desirable to reduce the number of moving parts associated with a powder hopper system.

It has also been known in the prior art to provide a vertical air pad inside of a material hopper and to blow air outward through the vertical air pad in order to fluidize the material in the vicinity of the vertical air pad. An example of such a vertical air pad is shown in U.S. Pat. No. 3,269,428 issued to Stockel et al. Although the vertical air pad disclosed in Stockel et al is effective for fluidizing material near the vertical air pad, it is still insufficient for preventing agglomeration of material along the walls of the hopper.

SUMMARY AND OBJECTS OF THE INVENTION

It is an object of the present invention to provide a powder hopper with an internal air assist which effectively fluidizes the powder within the powder hopper.

It is a further object of the present invention to provide an air assist device which prevents agglomeration of powder within the powder hopper.

It is still another object of the present invention to provide a powder agitating system with a reduced number of mechanically moving parts.

It is yet another object of the present invention to provide a rotating air tube or column with air passages directed throughout the powder medium to provide fluid-like properties thereto.

In a first embodiment of the present invention, one or more vertically extending tubes are coupled to the fluidized bed at the bottom of the powder hopper for conducting compressed air therethrough and out radially arranged openings in the vertically extending tubes. The tube is designed to rotate within the powder hopper thereby providing an air assist agitator throughout the powder contained in the hopper.

In a second embodiment according to the present invention, a vertically extending tube is stationary and is divided into a plurality of longitudinally extending internal tube zones, each zone being supplied with air via a controllable solenoid or shutter so as to provide sequential pulsing of compressed air through adjacent zones as one traverses the circumference of the tube. Accordingly, the sequential pulsing provides an equivalent air agitation rotating action as would be provided by mechanically rotating the tube itself.

The objects of the present invention are achieved by the first embodiment which provides a powder hopper with internal air assist, comprising: a powder chamber; an air supply means for supplying compressed air to said powder chamber; an elongated tube rotatably disposed within said powder chamber, said elongated tube having a hollow cavity in communication with said air supply means and having a plurality of air outlet ports disposed along said elongated tube in communication with said hollow cavity; and driving means for rotating said elongated tube.

The objects of the present invention are also achieved by the second embodiment which provides a powder hopper with internal air assist, comprising: a powder chamber; air supply means for supplying compressed air to said powder chamber; an elongated tube fixedly mounted vertically within said powder chamber, said elongated tube including a plurality of air outlet holes disposed in a plurality of vertical columns provided around a circumference of said elongated tube; and control means for supplying compressed air to said elongated tube such that air is discharged from adjacent vertical columns of air outlet holes sequentially so as to traverse the circumference of said elongated tube.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
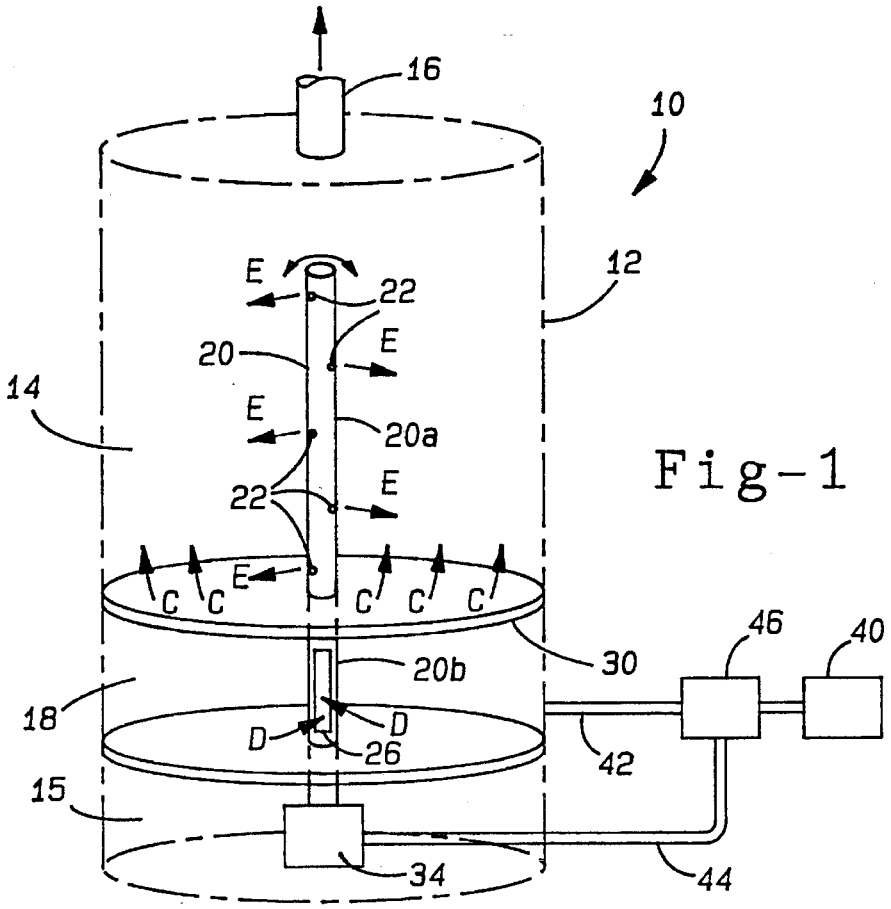
FIG. 1 illustrates a powder hopper according to a first embodiment of the present invention with an internal air assist system including a centrally located, rotatable, elongated tube having a plurality of air exhaust ports disposed in the radial surface thereof.

As shown in FIG. 1, a powder hopper 10 according to a first embodiment is shown. The powder hopper 10 is provided with a housing 12. The housing 12 includes a powder chamber 14 disposed in an upper portion of the housing 12. Below the powder chamber 14, the housing 12 includes a compressed air chamber 18. The upper powder chamber 14 is provided with an outlet 16 through which fluidized powder exits the powder chamber 14. The outlet 16 can be located in the top or in a side wall of the powder chamber 14.

A permeable membrane 30 is provided between the powder chamber 14 and the compressed air chamber 18. The permeable membrane 30 allows compressed air from the compressed air chamber 18 to pass therethrough and into the powder chamber 14. The permeable membrane 30 is preferably fixed to the housing 12 and sealed along its outer circumference so that powder cannot escape from the powder chamber into the compressed air chamber 18 when the powder hopper 10 is not operating.

A rotatable vertical tube 20 is centrally located within the powder chamber 14 and extends through a central portion of the permeable membrane 30. The vertical tube 20 is preferably circular in cross-section although it is recognized that a variety of cross-sections would be sufficient. The vertical tube 20 is provided with a plurality of air output holes 22 which are disposed on a portion 20*a* of the vertical tube which extends into the powder chamber 14. The vertical tube 20 can also be provided with nozzles (not shown) which direct the flow of air from the air output holes 22 in a predetermined direction.

The vertical tube 20 includes an air inlet port 26 which is disposed on a portion 20*b* of the vertical tube which is within the compressed air chamber 18 of the powder hopper 10. The air inlet port 26 allows the compressed air in the compressed air chamber to pass through the vertical tube 20 and out through the air outlet holes 22.

The vertical tube 20 is rotated about a central axis by a pneumatic rotating device 34. The pneumatic rotating device 34 is housed within a lowermost housing 15. It is recognized that an electric motor or other equivalent driving means can be used to rotate the vertical tube 20, so long as appropriate measures are taken to insure that combustible powder does not come in contact with the motor.

A compressor 40 is provided in communication with the compressed air chamber 18 by way of an air supply line 42. In addition, a controller 46 is provided for controlling the amount of air delivered to the compressed air chamber 18 and the pneumatic rotating device 34. Thereby, the controller 46 can separately control the speed of rotation of the vertical tube 20 and also the amount of air which passes through the permeable membrane 30 and the vertical tube 20.

In operation, the compressor 40 supplies compressed air to the controller 46 which supplies air through the supply line 42 into the compressed air chamber 18. In addition, the controller 46 supplies compressed air to the pneumatic rotating device 34 in order to rotate the vertical tube 20 at a desired rotational speed. The compressed air in the compressed air chamber 18 passes through the permeable membrane 30, as illustrated by arrows C, and also through the air inlet port 26 of the vertical tube 20, as illustrated by arrows D. The compressed air which enters the air inlet port 26 of the vertical tube 20 then passes through the hollow portion of the vertical tube and out through the air output ports 22, as illustrated by arrows E. The compressed air which exits through the air output ports 22 agitates the powder in the powder chamber 14 while the pneumatic rotating device 34 rotates the vertical tube 20, and thereby increases the amount of fluidized powder in the powder chamber 14. As the powder is fluidized, the fluidized powder is exhausted from the powder chamber 14 through the exhaust port 16.

In the embodiment described above, the vertical tube 20 is supplied with compressed air from the compressed air chamber 18 by way of an opening or a plurality of openings 26. Alternatively, the vertical tube 20 could be provided with compressed air directly through a separate supply line. A separate supply line would allow different air pressures to be used in the compressed air chamber 18 and in the vertical tube 20. An example of such a direct supply line system is illustrated in FIG. 2 which is described hereinbelow.

Figure 2:
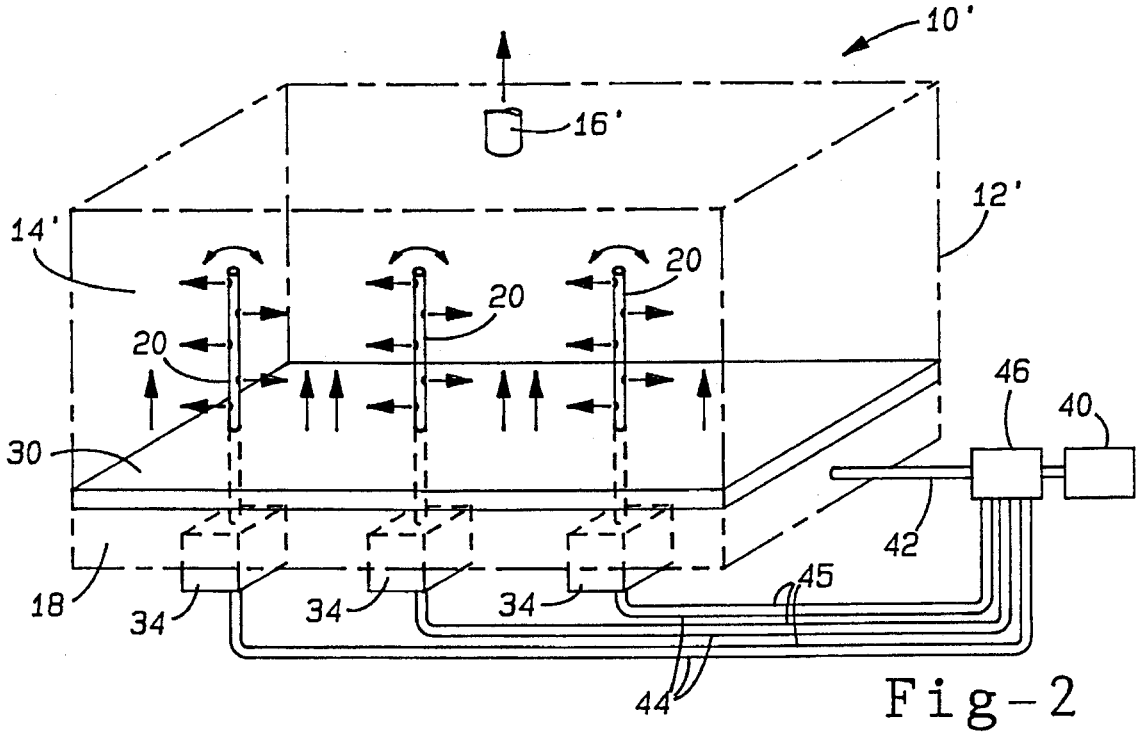
FIG. 2 illustrates an internal air assist system which includes a plurality of elongated tubes of the type disclosed in FIG. 1.
Figure 3:
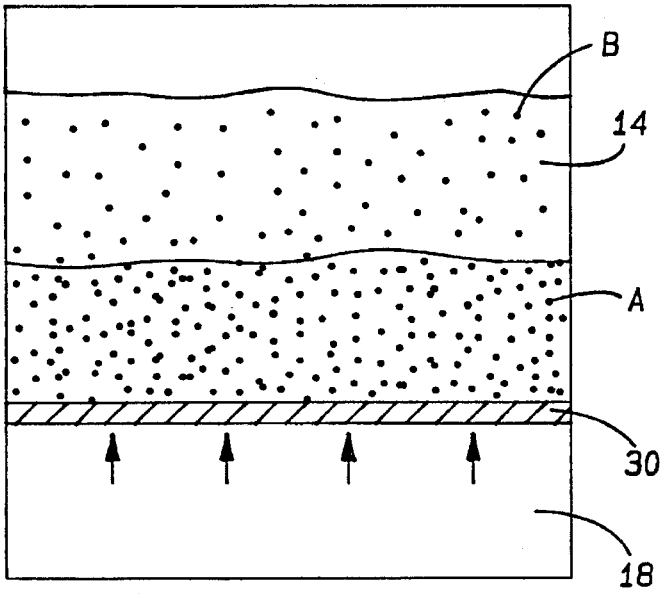
PRIOR ART Fig-3
FIG. 3 is a schematic view of a conventional powder fluid bed having a fluidized powder level and a non-fluidized powder level.

FIG. 2 schematically illustrates the use of a plurality of vertically extending tubes as internal air assist mechanisms for agitating the powder. In FIG. 2, the same reference numerals used to designate the elements in FIG. 1 are used to designate the same elements shown in FIG. 2. The vertically extending tubes 20 are provided in a spaced relationship from one another within the housing 12' of the powder hopper 10'. Within the housing 12' there is provided a powder chamber 14' and a compressed air chamber 18 which are divided by a permeable membrane 30. A lowermost housing portion could optionally be provided below the compressed air chamber 18.

Each of the vertically extending tubes 20 are driven by pneumatic actuators 34 which are each provided with compressed air by the controller 46 by way of supply lines 44. The vertical tubes 20 are each provided with separate compressed air supply lines 45. The separate supply lines 45 allow a different air pressure to be supplied to the vertical tubes 20 and the compressed air chamber 18.

Figure 4:
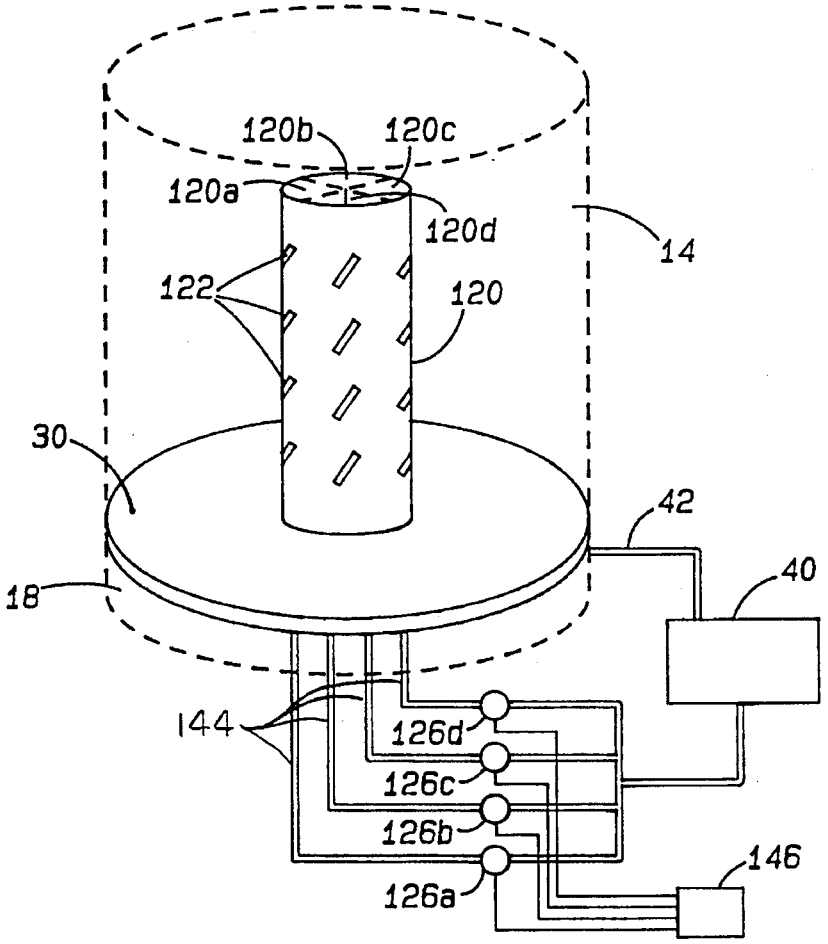
FIG. 4 schematically illustrates an internal air assist system including a fixedly mounted elongated tube having a plurality of partitioned zones which communicate individually to an air supply through individual solenoids, the solenoids are controlled so as to provide sequential air pulses to each of the partitioned zones so as to obtain the effect of a rotating tube without the requirement of having any moving parts.

FIG. 4 illustrates a second embodiment of the present invention in which the same reference numerals used to designate the elements in earlier figures are used to designate the same elements. The embodiment of FIG. 4 is provided with a vertically extending tube 120 which includes a plurality of air outlet holes 122. The air outlet holes disclosed in FIG. 4 are slanted slots, however, it is to be understood that the holes can have a variety of shapes and can also be provided with nozzles for directing the flow of air in a desired direction. The vertically extending tube 120 is also divided by partitions into a plurality of air passage zones 120*a*–120*d*, as illustrated by phantom lines in the top portion of the vertical tube 120. The top of the vertical tube 120 is enclosed. Although four zones 120*a*–120*d* are illustrated in FIG. 4, any plurality of zones may be used without departing from the spirit and scope of the present invention.

Each zone 120*a*–120*d* of the vertical tube 120 is supplied with compressed air via air supply lines 144 and controllable solenoid valves 126*a*–126*d*. The solenoid valves 126*a*–126*d* are provided with a controller 146 which opens and closes said solenoid valves 126*a*–126*d* such that sequential pulsing of the solenoids will provide a sequential compressed air outlet as one traverses the circumference of the tube, thereby providing an equivalent air agitation rotating action as would be provided by mechanically rotating the tube itself.

Figure 5:
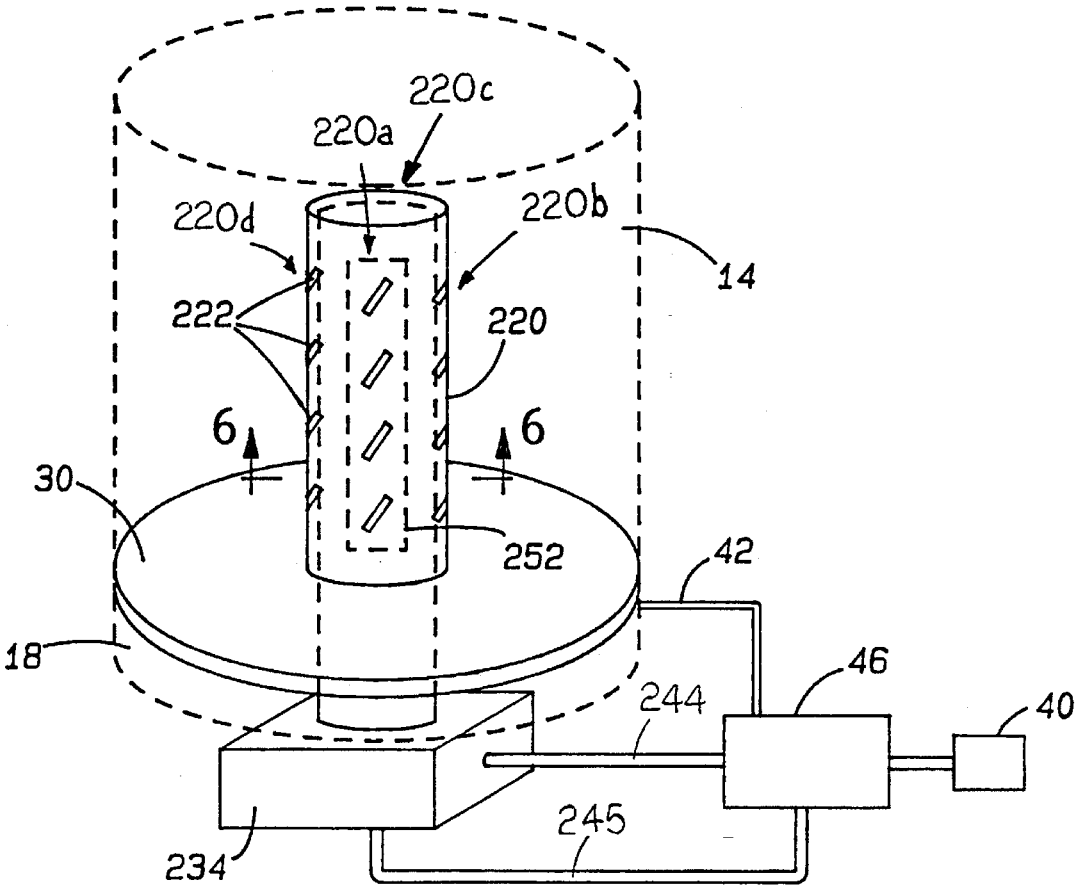
FIG. 5 schematically illustrates an internal air assist system including a fixedly mounted elongated tube having an internal rotatable shutter for providing sequential air pulses to each of the partitioned zones so as to obtain the effect of a rotating tube without rotating the external elongated tube.
Figure 6:
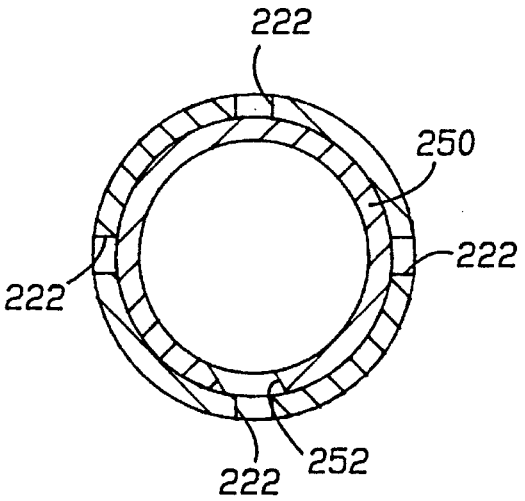
FIG. 6 is a sectional view along line 6—6 of FIG. 5, illustrating the relationship between the elongated tube and the rotatable shutter.

FIGS. 5 and 6 schematically illustrate an alternative to the embodiment shown in FIG. 4. In FIG. 5, a stationary vertical tube 220 is provided. The vertical tube 220 is hollow and is provided with a plurality of air output holes 222 which are arranged in a plurality of vertical columns. The plurality of vertical columns of air output holes each define a zone 220*a*–220*d*. As shown in FIG. 5, a rotatable shutter 250 is provided within the vertical tube 220. The rotatable shutter 250 is in the form of a cylinder having a slot-like opening 252 provided in one side thereof. The slot like opening 252 is shown in FIG. 6, however the relationship of the slot-like opening 252 to the zones 220*a*–220*d* of the vertical tube 220 is best shown by the phantom lines in FIG. 5. The rotatable shutter 250 is rotated within the vertical tube 220 so as to sequentially expose each zone 220*a*–220*d* of air output holes to the internal air pressure supplied to the rotatable shutter 250 by air supply line 245. The rotatable shutter 250 is rotatably driven by a pneumatic actuator 234 which is drivingly connected to the rotatable shutter 250. The pneumatic actuator 234 is supplied with compressed air by air supply line 244.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A powder hopper with internal air assist, comprising:

a powder chamber;

air supply means for supplying compressed air to said powder chamber;

an elongated tube rotatably disposed within said powder chamber, said elongated tube having a hollow cavity in communication with said air supply means and having a plurality of air outlet ports disposed along said elongated tube in communication with said hollow cavity; and driving means for rotating said elongated tube.

2. The powder hopper according to claim 1, further comprising a compressed air chamber beneath said powder chamber and a permeable membrane disposed between said powder chamber and said compressed air chamber.

3. The powder hopper according to claim 2, wherein said elongated tube extends through said permeable membrane.

4. The powder hopper according to claim 3, wherein said elongated tube is provided with an air inlet opening which communicates with said compressed air chamber.

5. The powder hopper according to claim 3, further comprising an air supply line for delivering compressed air directly to said hollow cavity of said elongated tube from said air supply means.

6. The powder hopper according to claim 5, wherein said air supply means includes controller means for controlling an amount of compressed air delivered to said compressed air chamber and to said hollow cavity of said elongated tube.

7. The powder hopper according to claim 1, wherein said air supply means is a compressor.

8. The powder hopper according to claim 1, wherein said air supply means includes controller means for controlling an amount of compressed air delivered to said compressed air chamber.

9. A powder hopper with internal air assist, comprising:

a powder chamber;

air supply means for supplying compressed air to said powder chamber; and an elongated tube fixedly mounted vertically within said powder chamber, said elongated tube having a plurality of partitioned cavities, each of said plurality of partitioned cavities having a respective valve means for connecting said plurality of partitioned cavities with said air supply means, each of said plurality of partitioned cavities having a plurality of radially extending air outlet holes.

10. The powder hopper according to claim 9, wherein each of said valve means are opened and closed sequentially such that air is delivered sequentially to adjacent partitioned cavities so as to traverse a circumference of said elongated tube.

11. The powder hopper according to claim 10, wherein said elongated tube is fixedly attached to said permeable membrane.

12. The powder hopper according to claim 9, further comprising a compressed air chamber beneath said powder chamber and a permeable membrane disposed between said powder chamber and said compressed air chamber.

13. The powder hopper according to claim 9, wherein said air supply means is a compressor.

14. The powder hopper according to claim 9, wherein said air supply means includes controller means for controlling an amount of compressed air delivered to said compressed air chamber.

15. A powder hopper with internal air assist, comprising:

a powder chamber;

air supply means for supplying compressed air to said powder chamber;

an elongated tube fixedly mounted vertically within said powder chamber, said elongated tube including a plurality of air outlet holes disposed in a plurality of vertical columns provided around a circumference of said elongated tube; and control means for supplying compressed air to said elongated tube such that air is discharged from adjacent vertical columns of air outlet holes sequentially so as to traverse the circumference of said elongated tube.

16. The powder hopper according to claim 15, further comprising a compressed air chamber beneath said powder chamber and a permeable membrane disposed between said powder chamber and said compressed air chamber.

17. The powder hopper according to claim 15, wherein said elongated tube is fixedly attached to said permeable membrane.

18. The powder hopper according to claim 15, wherein said air supply means is a compressor.

19. The powder hopper according to claim 15, wherein said air supply means includes air supply controller means for controlling an amount of compressed air delivered to said compressed air chamber.

20. The powder hopper according to claim 15, wherein said control means includes a rotatable shutter disposed within said elongated tube.

21. A powder hopper with internal air assist, comprising:

a powder chamber;

a compressed air chamber beneath said powder chamber and a permeable membrane disposed between said powder chamber and said compressed air chamber;

air supply means for supplying compressed air to said powder chamber and said compressed air chamber; and an elongated tube mounted vertically within said powder chamber, said elongated tube including a plurality of air outlet holes disposed radially therein; and means for discharging compressed air through said air outlet holes of said elongated tube so as to cause a rotational air assist within said powder chamber.

22. The powder hopper according to claim 21, wherein said elongated tube is rotatably mounted within said powder chamber, said elongated tube having a hollow cavity in communication with said air supply means, said plurality of air outlet ports disposed along said elongated tube being in communication with said hollow cavity; and wherein the means for discharging includes driving means for rotating said elongated tube.

23. The powder hopper according to claim 21, Wherein said elongated tube is fixedly mounted within said powder chamber, said elongated tube having a plurality of partitioned cavities, each of said plurality of partitioned cavities having a respective valve means for connecting said plurality of partitioned cavities with said air supply means, each of said plurality of partitioned cavities having a plurality of radially extending air outlet holes, wherein said means for discharging include means for sequentially opening and closing said valve means such that air is delivered sequentially to adjacent partitioned cavities so as to traverse a circumference of said elongated tube.

24. The powder chamber according to claim 21, wherein said plurality of air outlet holes are disposed in a plurality of vertical columns provided around a circumference of said elongated tube, and the means for discharging further comprising control means for supplying compressed air to said elongated tube such that air is discharged from adjacent vertical columns of air outlet holes sequentially so as to traverse the circumference of said elongated tube, wherein said control means includes a rotatable shutter disposed within said elongated tube.

* * * * *